US008686929B2

(12) United States Patent
Oh

(10) Patent No.: US 8,686,929 B2
(45) Date of Patent: Apr. 1, 2014

(54) ORGANIC LIGHT EMITTING DISPLAY AND METHOD OF MANUFACTURING THE SAME

(75) Inventor: Eun-jung Oh, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1602 days.

(21) Appl. No.: 11/930,580

(22) Filed: Oct. 31, 2007

(65) Prior Publication Data

US 2008/0218449 A1 Sep. 11, 2008

(30) Foreign Application Priority Data

Mar. 8, 2007 (KR) ..... 10-2007-0022938

(51) Int. Cl.
*G09G 3/32* (2006.01)
*G09G 3/30* (2006.01)

(52) U.S. Cl.
USPC ..... 345/82; 345/76

(58) Field of Classification Search
USPC ..... 345/82
See application file for complete search history.

(56) References Cited

U.S. PATENT DOCUMENTS

| | | | | |
|---|---|---|---|---|
| 7,551,112 | B2 | 6/2009 | Choi et al. | |
| 2003/0063053 | A1* | 4/2003 | Yamazaki et al. | 345/82 |
| 2005/0174309 | A1* | 8/2005 | Bouwens et al. | 345/83 |
| 2006/0012311 | A1 | 1/2006 | Ogawa | |
| 2006/0061593 | A1 | 3/2006 | Miura et al. | |
| 2006/0164408 | A1 | 7/2006 | Nishikawa et al. | |

FOREIGN PATENT DOCUMENTS

| | | |
|---|---|---|
| JP | 2005-338157 | 12/2005 |
| KR | 2005-104598 | 11/2005 |
| KR | 2006-50027 | 5/2006 |
| KR | 2006-50070 | 5/2006 |
| KR | 2006-51516 | 5/2006 |
| KR | 10-671648 | 1/2007 |
| KR | 2007-19904 | 2/2007 |

OTHER PUBLICATIONS

Office Action issued by the Korean Intellectual Property Office on Dec. 5, 2008.
Office Action issued by Korean Intellectual Property Office in Korean Application No. 2007-22938 on Jun. 23, 2008.
Office Action issued in the Korean Intellectual Property Office on May 26, 2009.

* cited by examiner

*Primary Examiner* — Charles V Hicks
(74) *Attorney, Agent, or Firm* — Christie, Parker & Hale, LLP

(57) ABSTRACT

An organic light emitting display including: a pixel unit to display an image, according to a data signal and a scan signal; a data driver to supply the data signal, according to a video signal; and a scan driver to supply the scan signal. The data driver includes a memory to store a corrected offset voltage and to control a voltage of the data signal according to the corrected offset voltage.

20 Claims, 4 Drawing Sheets

ORGANIC LIGHT EMITTING DISPLAY AND METHOD OF MANUFACTURING THE SAME

CROSS-REFERENCE TO RELATED APPLICATION

This application claims the benefit of Korean Application No. 2007-22938, filed Mar. 8, 2007, in the Korean Intellectual Property Office, the disclosure of which is incorporated herein by reference.

BACKGROUND OF THE INVENTION

1. Field of the Invention

Aspects of the present invention relate to an organic light emitting display and a method of manufacturing the same 2. Description of the Related Art Recently, various flat panel displays, which have a lightweight and a small-volume as compared to cathode ray tubes (CRT), have been developed. In particular, organic light emitting display devices, which have excellent emission efficiency, luminance, viewing angle, and response speed, have been highlighted.

An organic light emitting display displays an image by using a plurality of organic light emitting diodes (OLED). An OLED includes an anode electrode, a cathode electrode, and an organic emission layer. The organic emission layer is disposed between the anode electrode and the cathode electrode and emits light by a combination of electrons and holes.

The organic light emitting display displays a high brightness, if a large amount of current flows in its organic light emitting diodes, and displays a low brightness, if a small amount of current flows in its organic light emitting diodes. Gradation levels are controlled by the amount of current amount flowing in the organic light emitting diodes.

At the same applied voltage, different organic light emitting displays produce different brightness levels, because the current flowing in the organic light emitting diodes varies, according to the manufacturing processes used to produce the organic light emitting displays.

FIG. 1 is a graph showing brightness distribution of a related art organic light emitting displays. Referring to FIG. 1, the horizontal axis shows brightness levels, the vertical axis shows quantity (numbers of displays), and the dotted line shows a standardized normal range.

When measuring a brightness of the organic light emitting displays, the displays can each have a different brightness, thereby filling the brightness distribution illustrated in FIG. 1. A brightness of around 150 is a targeted level, and a brightness ranging between 128 and 172 is determined to be the normal range.

The organic light emitting displays in the normal range have no restriction on use, since users may not notice a brightness difference. However, the organic light emitting displays having a brightness outside of the normal range display images that are too dark or images that appear washed out. Therefore, the visibility of such displays is poor, and proper images are not displayed, causing such displays to be undesirable.

SUMMARY OF THE INVENTION

Aspects of the present invention provide an organic light emitting display system capable of reducing a defective proportion of produced displays by correcting the brightness thereof, if the brightness deviates from a normal brightness range.

Aspects of the present invention provide an organic light emitting display including: a pixel unit to display an image, according to a received data signal and scan signal; a data driver to produce the data signal, according to a received video signal, and to control a voltage of the data signal using a corrected offset voltage; and a scan driver to produce the scan signal. The data driver includes a memory to store the corrected offset voltage and to control the voltage of the data signal, according to the stored offset voltage.

Aspects of the present invention provide a method of manufacturing an organic light emitting display, which displays an image corresponding to a data signal and a scan signal. The method includes: measuring a brightness of a display; determining a corrected offset voltage corresponding to the measured brightness; and using the corrected offset voltage to produce the data signal, by storing the corrected offset voltage in a memory.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will be more apparent and more readily appreciated from the following description of the exemplary embodiments, taken in conjunction with the accompanying drawings, of which.

DETAILED DESCRIPTION OF THE EMBODIMENTS

Figure 1:
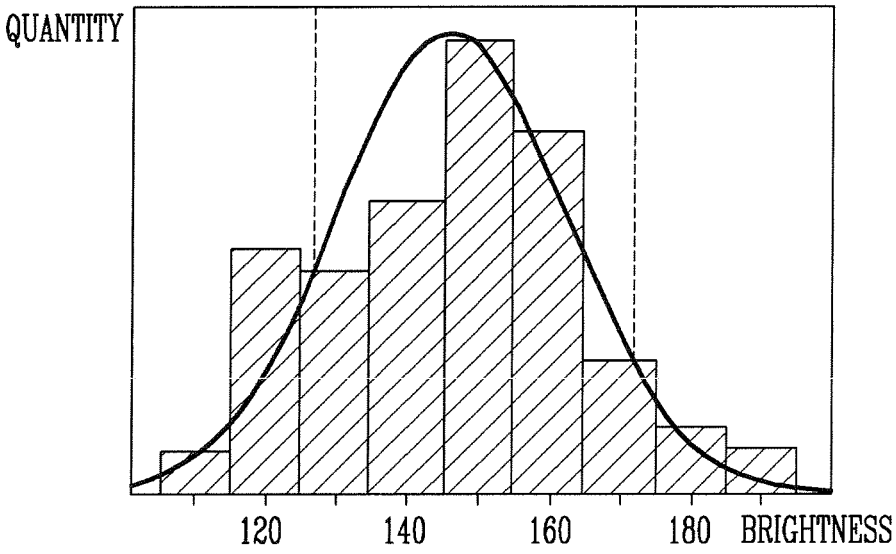
FIG. 1 (RELATED ART)
FIG. 1 is a graph showing brightness distribution of a organic light emitting displays.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
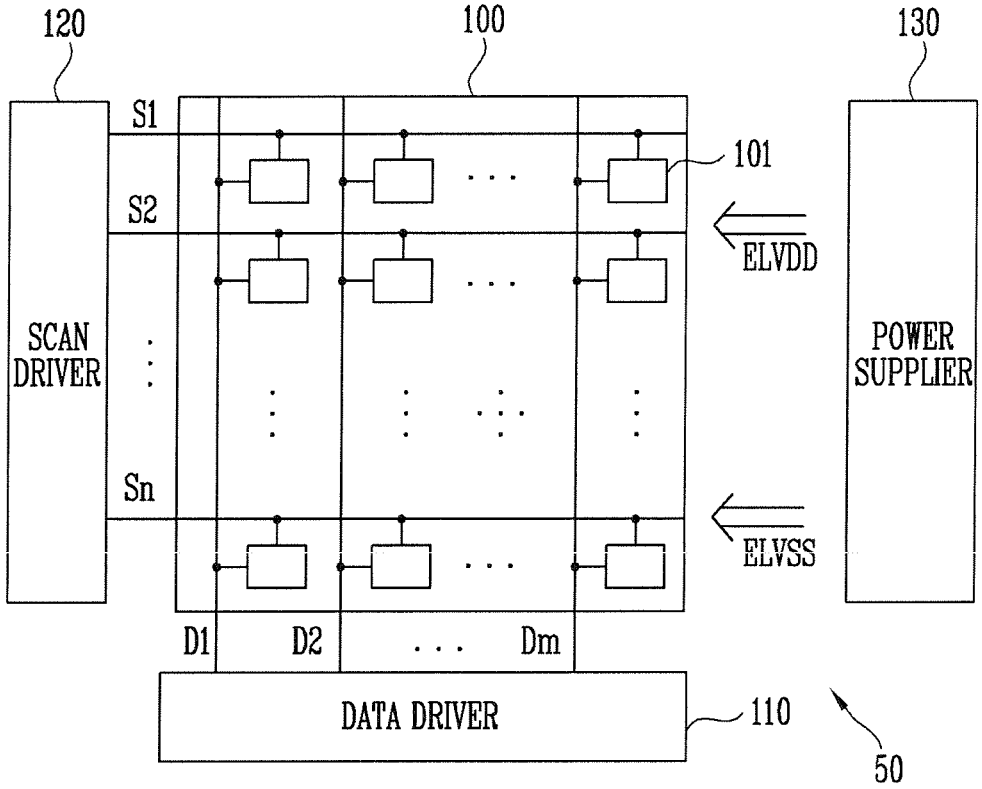
FIG. 2 is a structural view showing the structure of an organic light emitting display.

FIG. 2 is a structural view showing the structure of an organic light emitting display 50. Referring to FIG. 2, the organic light emitting display 50 includes a pixel unit 100, a data driver 110, a scan driver 120, and a power supply 130.

A plurality of pixels 101 are arranged in the pixel unit 100. Each of the pixels 101 includes an organic light emitting diode (not shown), which emits light according to a current flow. Scan lines (S1, S2, . . . Sn−1, Sn), which transmit scan signals, are arranged in a row direction. Data lines (D1, D2, . . . Dm−1, Dm), which transmit data signals, are arranged in a column direction, in the pixel unit 100. The scan lines (S1, S2, . . . Sn−1, Sn) receive a first voltage ELVDD from the power supply 130 and are driven in response thereto. The data lines (D1, D2, . . . Dm−1, Dm) receive a second voltage from the power supply 130 ELVSS and are driven in response thereto. Accordingly, in the pixel unit 100, an organic light emitting diode emits light in response to the scan signal, the data signal, a first voltage ELVDD, and a second voltage ELVSS, to display images.

The data driver 110, which applies the data signals to the pixel unit 100, produces the data signals by receiving video signals having constituents of red, blue, and green. The data driver 110 applies the data signal through the data lines (D1, D2, . . . Dm−1, Dm) to the pixel unit 100.

The scan driver 120, which applies the scan signals to the pixel unit 100, transmits the scan signals to certain rows of the pixel unit 100, through the scan lines (S1, S2, . . . Sn−1, Sn). The data signals output from the data driver 110 are transmitted to the pixels 101, to which the scan signals is transmitted. The data signals from the data driver 110 are applied to certain rows of the pixel unit 100, to which the scan signals are transmitted, so that a current corresponding to the data signal flows in each pixel 101.

The power supply 130 can comprise a first power source (not shown) to produce the first voltage ELVDD and a second power source (not shown) to produce the second voltage ELVSS. The power supply 130 produces and transmits the first voltage ELVDD and the second voltage ELVSS, by receiving power from an external source.

Figure 3:
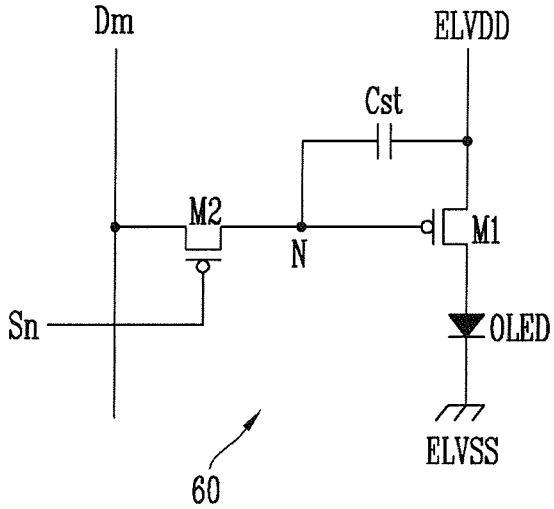
FIG. 3 is a structural view showing the structure of a pixel employed in the organic light emitting display described in FIG. 2.

FIG. 3 is a structural view showing the structure of a pixel 60, employed in the organic light emitting display 50. Referring to FIG. 3, the pixel 60 includes a first transistor M1, a second transistor M2, a capacitor Cst, and an organic light emitting diode (OLED).

A source of the first transistor M1 receives the first voltage ELVDD, a drain thereof is coupled to the OLED, and a gate thereof is coupled to a first node N1. A source of the second transistor M2 is coupled to a data line Dm, a drain thereof is coupled to the first node N1, and a gate thereof is coupled to the scan line Sn. A first electrode of the capacitor Cst is coupled to receive the first voltage ELVDD, and a second electrode thereof is coupled to the first node N1. The OLED includes an anode electrode, a cathode electrode, and an emission layer, which is interposed between the anode electrode and the cathode electrode. The emission layer emits light when current flows between the anode electrode and the cathode electrode. The anode electrode of the OLED is coupled to the drain of the first transistor M1, and a cathode electrode thereof is coupled to receive the second voltage ELVSS.

In an operation of the pixel 60, when the scan signal is low, the second transistor M2 is turned on. Thus, a data signal transferred through the data line Dm is provided to the first node N1. Accordingly, the data signal is transferred to the second electrode of the capacitor Cst. At this time, the first voltage ELVDD has been transferred to the first electrode of the capacitor Cst. When the scan signal is high, the second transistor M2 is turned off, and thus, is disposed in a floating state between the first node N1 and the data line Dm. A voltage of the first node N1 is maintained at a voltage of the data signal, by the capacitor Cst. A voltage of the first node N1 is transferred to the gate of the first transistor M1, so that a current corresponding to the voltage of the first node N1 flows from a source of the first transistor M1 to a drain side thereof. The current is transmitted to the OLED, so that the OLED emits light.

Figure 4:
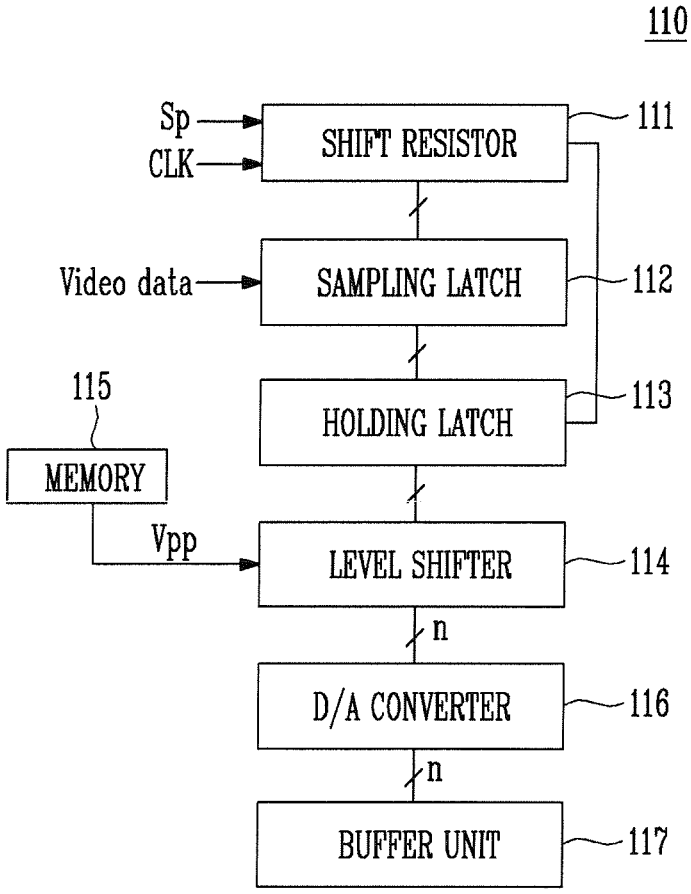
FIG. 4 is a structural view showing the structure of a data driver employed in the organic light emitting display described in FIG. 2.

FIG. 4 is a structural view showing the structure of the data driver 110 employed in the organic light emitting display 50. Referring to FIG. 4, the data driver 110 includes a shift resistor 111, a sampling latch 112, a holding latch 113, a level shifter 114, a memory 115, a D/A converter 116, and a buffer unit 117.

The shift resistor 111 comprises a plurality of flip flops and controls the sampling latch 112, in accordance with a clock signal (CLK) and a synchronizing signal (Hsync). The sampling latch 112 sequentially receives data signals of one row and outputs the received data signals in parallel, depending on a control signal of the shift resistor 111. The process, in which the signals are sequentially received and output in parallel by the sampling latch 112, is referred to as SIPO (Serial In Parallel Out).

The holding latch 113 receives signals in parallel and outputs the received signals in parallel. The process, in which the signals are received in parallel and outputted in parallel by the holding latch 113, is referred to as PIPO (Parallel In Parallel Out). The level shifter 114 converts the signals output from the holding latch 113 into an operation voltage of the system, to transmit the converted signals to the D/A converter 116. The memory 115 stores and transmits an offset voltage VPP to the level shifter 114. The memory 115 converts the signals, output from the holding latch 113, into an operation voltage of the system, according to the offset voltage transmitted from the level shifter 114. The D/A converter 116 converts digital signals from the level shifter 114 to analog signals and selects a corresponding grey scale voltage. The D/A converter transmits the selected grey scale voltage to the buffer unit 117. The buffer unit 117 amplifies the grey scale voltage and transmits the amplified grey scale voltage to the data lines (D1, D2, . . . Dm−1, Dm).

Figure 5:
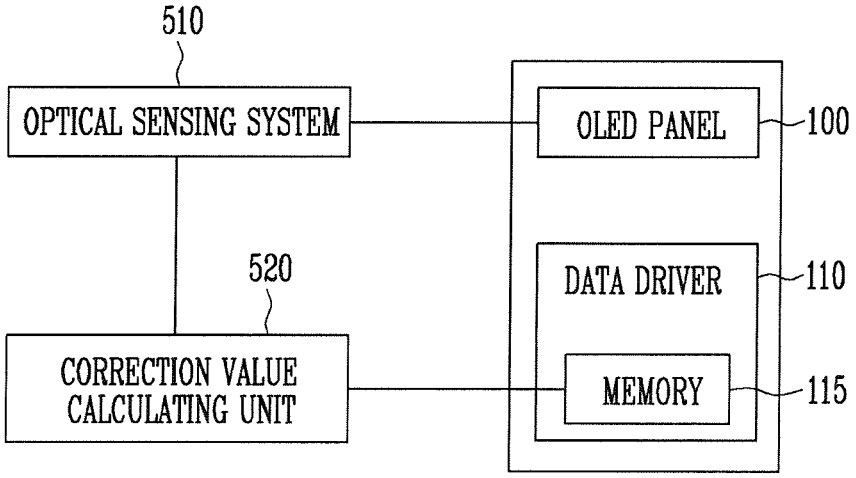
FIG. 5 is a structural view showing a correction system to store a corrected offset voltage in a memory of the data driver described in FIG. 4.
Figure 6:
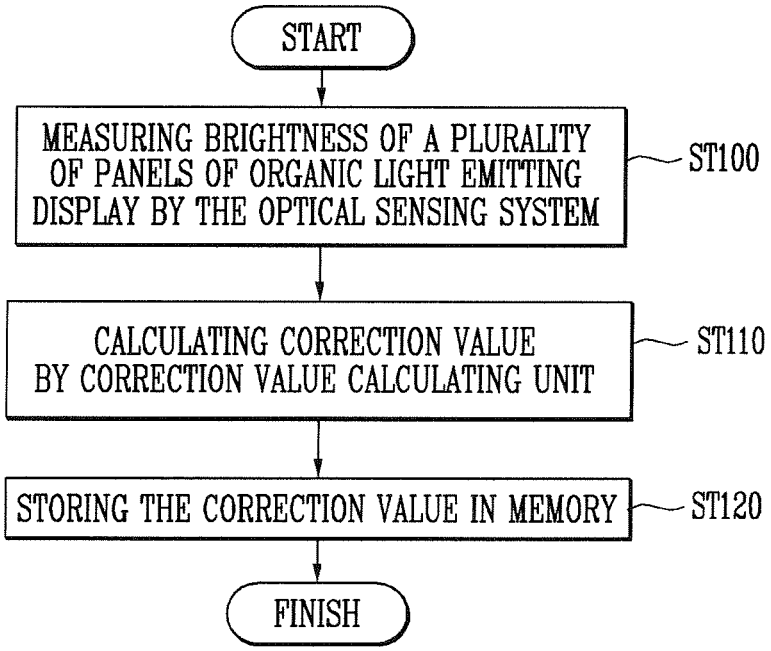
FIG. 6 is a flow chart showing a process for storing the corrected offset voltage in a memory, using the correction system.

FIG. 5 is a structural view showing a correction system 70 to store an offset voltage in a memory 532 of the data driver 110, and FIG. 6 is a flow chart showing a process for storing the offset voltage in the memory, using the correction system 70. Referring to FIGS. 5 and 6, the correction system 70 includes an optical sensing system 510 and a correction value calculating unit 520. The optical sensing system 510 measures a brightness and/or a chromaticity of the pixel unit 100, of the organic light emitting display 50. The memory 532 can be any suitable type of memory, for example, a RAM memory, a flash memory, or the like.

In operation ST100, the brightness of the pixel unit 100 is measured by the optical sensing system 510. Each pixel unit 100 (display) receives the identical data signal and voltage. The data driver 110 displays an image by storing the offset voltage in the memory 531. The optical sensing system 510 measures the brightness of the pixel units 100, which display an image according to the offset voltage. The optical sensing system 510 senses the brightness and/or chromaticity of the pixel units 100 and classifies the pixel unit 100 as a standard product, which has a brightness in a standard range, or a substandard product, which has a brightness outside of the standard range.

In operation ST110, the correction value calculating unit 520 calculates a correction value for the substandard product, by using the brightness measured by the optical sensing system 510. The correction value can be used to produce a corrected offset voltage. The corrected offset voltage can be calculated by the correction value calculating unit 520. In some exemplary embodiments, the correction value calculating unit 520 can send the correction value to the memory 532, and the data driver 110 can calculate the corrected offset voltage using the correction value. As referred to herein, calculating the corrected offset voltage applies to either method. In addition the correction value and/or the corrected offset voltage can be stored in the memory 532. In various embodiments, the correction value calculating unit can be optionally incorporated into the data driver 110. In some embodiments the correction value calculating unit 520 can be incorporated into the optical sensing system 510.

The corrected offset voltage is calculated, according to the brightness measured by the optical sensing system 510, such that the brightness can be properly adjusted by applying the corrected offset voltage. That is, if the pixel unit 100 displays an image having a low brightness, the corrected offset voltage is calculated to increase the brightness of the image. If the pixel unit 100 displays the image with a high brightness, the corrected offset voltage is calculated to lower the brightness of the image.

The pixels 101 of the pixel unit 100 can be various types of pixels, for example, red, blue, or green pixels 101. Each pixel 101 can have a different brightness level. Correction values can be calculated for each type of pixel 101. Corrected offset voltages can be calculated according to each correction value.

If a brightness error of the organic light emitting display 530 is large, the brightness error can be corrected in multiple steps. That is, the brightness may not be corrected to the normal range in a single step. Or, for example, the brightness my be in the normal range, but a white balance thereof can be degraded, since each of the red, blue, and green pixels 101 can have a different brightness. In either case, the brightness of the pixel panel 100 is measured again, when the corrected offset voltage is applied thereto. The corrected offset voltage can be recalculated to produce a suitable white balance, by finely readjusting the corrected offset voltage, according to the respective brightness of the red, blue, and green pixels 101. In some embodiments, a correction value can be determined for each type of pixel 101, and corrected offset voltages can be calculated for each type of pixel.

In operation ST120, the correction value, and/or the corrected offset voltage, is stored in the memory 532 of the data driver 110. The data driver 110 operates according to the corrected offset voltage stored in the memory 532. In various embodiments, a correction value can be stored for each type of pixel, and applied by the data driver to the red, green, and blue, portions of the data signal.

According to various embodiments, the organic light emitting displays having a brightness difference, which is not in the normal range, can be modified by controlling an offset voltage, so that the brightness of the products can be adjusted to a suitable range. As a result, yield and productivity can be improved.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An organic light emitting display comprising:

a pixel unit to display an image by receiving a data signal and a scan signal;

a data driver to produce the data signal according to a video signal, and to control a voltage of the data signal according to a first offset voltage derived from optical detection of the image displayed on the pixel unit; and a scan driver to produce the scan signal, wherein the data driver comprises:

a memory to store the first offset voltage and controls the voltage of the data signal according to the stored offset voltage;

a shift register unit to output a control signal;

a latch unit to receive the video signal in series and to output the data signal in parallel, according to the control signal;

a level shifter to control a voltage of the data signal output from the latch unit, according to the first offset voltage stored in the memory; and a D/A converter to receive the data signal from the level shifter, and to convert the data signal into an analog signal.

2. The organic light emitting display of claim 1, wherein the first offset voltage corresponds to a red, a green, and a blue aspect of the video signal.

3. The organic light emitting display of claim 1, wherein the memory is a flash memory.

4. A method of manufacturing an organic light emitting display, which displays an image corresponding to a data signal and a scan signal, the method comprising:

optically measuring a brightness of the image;

calculating a first correction value corresponding to the measured brightness and calculating a first corrected offset voltage according to the first correction value; and storing the first corrected offset voltage in a memory of the display.

5. The method of claim 4, wherein the calculating comprises calculating the first correction value according to a red, a green, and a blue aspect of the data signal.

6. The method of claim 4, wherein the brightness corresponds to an initial offset voltage, and the first correction value is calculated to convert the initial offset voltage into the first corrected offset voltage.

7. The method of claim 4, wherein the measuring of the brightness comprises measuring a chromaticity of the image, and the first correction value corresponds to the chromaticity.

8. The method of claim 4, further comprising:

remeasuring the brightness of the image while applying the first corrected offset voltage to the display; and recalculating the first corrected offset voltage according to the remeasured brightness.

9. The organic light emitting display of claim 1, wherein the memory stores a second offset voltage and a third offset voltage, and the first, second, and third offset voltages respectively correspond to red, green, and blue aspects of the data signal.

10. The organic light emitting display of claim 1, further comprising a buffer unit to store the analog signal.

11. The method of claim 4, wherein the display produces the data signal in accordance with the first corrected offset voltage.

12. The method of claim 4, wherein the calculating comprises calculating a second correction value and a third correction value, and calculating a second offset voltage and a third offset voltage, according to the second and third correction values, and the first corrected offset voltage, the second offset voltage, and the third offset voltage respectively correspond to red, green, and blue aspects of the data signal.

13. The method of claim 8, wherein the remeasuring comprises measuring a white balance of the display, and the recalculating compensates for the white balance.

14. A correction system for an organic light emitting display to form an image according to video signal and comprising a data driver and a memory, the system comprising;

an optical sensing system to sense a brightness of the display according to an offset voltage applied to the display; and a correction value calculating unit to calculate a correction value, according to the brightness, and to send the correction value to the memory, wherein the correction value corresponds to a corrected offset voltage, and the corrected offset voltage corresponds to a brightness of the display within a predetermined brightness range.

15. The system of claim 14, wherein the correction value calculating unit calculates the corrected offset voltage.

16. The system of claim 14, wherein the correction value calculating unit recalculates the correction value when the corrected offset voltage is applied to the display.

17. The system of claim 16, wherein the recalculated correction value is calculated according to a white balance of the display.

18. The system of claim 14, wherein the optical sensing system determines a white balance of the display.

19. The system of claim 14, wherein the correction value calculating unit calculates the correction value according to a red, a green, and a blue aspect of the video signal.

20. The system of claim 14, wherein the correction value calculating unit calculates correction values corresponding to a red, a green, and a blue aspect of the video signal.

* * * * *